United States Patent [19]

Stoody

[11] Patent Number: 4,773,567

[45] Date of Patent: Sep. 27, 1988

[54] CHILD RESISTANT LATCHING ACTUATOR FOR AEROSOL/PUMP VALVE

[76] Inventor: William R. Stoody, 8659 Summerdale Rd., San Diego, Calif. 92126

[21] Appl. No.: 80,201

[22] Filed: Jul. 30, 1987

Related U.S. Application Data

[63] Continuation of Ser. No. 854,090, Apr. 21, 1986, abandoned.

[51] Int. Cl.[4] ..... B67D 5/00

[52] U.S. Cl. ..... 222/153; 222/402.11

[58] Field of Search ..... 222/153, 402.11, 402.13, 222/402.17; 251/95, 100, 103, 114

[56] References Cited

U.S. PATENT DOCUMENTS

| | | | |
|---|---|---|---|
| 3,591,128 | 7/1971 | Ramis | 222/402.11 |
| 3,721,423 | 3/1973 | Shay | 222/402.11 |
| 3,827,605 | 8/1974 | Knickerbocker | 222/153 |
| 3,860,149 | 1/1975 | Hagianis | 222/153 |
| 4,566,611 | 1/1986 | Sukopp | 222/402.11 |

FOREIGN PATENT DOCUMENTS

| | | | |
|---|---|---|---|
| 27890 | 6/1921 | Denmark | 251/115 |

*Primary Examiner*—H. Grant Skaggs

[57] ABSTRACT

A fluid dispenser valve actuator that includes stop and abuttments that accommodate selective positioning of the actuator to an OFF position, preventing opening of the valve, from an ON position facilitating opening of the valve, and vice-versa. The actuator also includes a manipulative latching pawl and a catch that are latchingly engaged to prevent a positional change when the actuator is in the OFF position, except when pawl is manipulated to disengage the catch.

10 Claims, 2 Drawing Sheets

CHILD RESISTANT LATCHING ACTUATOR FOR AEROSOL/PUMP VALVE

This application is a continuation of application Ser. No. 854,090, filed Apr. 21, 1986, now abandoned.

RELATED APPLICATIONS

The applicant's related co-pending application is: Ser. No. 770,565 filed Aug. 29, 1985 and now U.S. Pat. No. 4,735,346.

BACKGROUND OF THE INVENTION

The present invention discloses an improved child resistant pushbutton type valve actuator, usable on aerosol and pump type dispensers. The invention is unique in that the actuator is positionable to OFF and ON positions, and includes a stop means that prevents operation of the valve when the actuator is in the OFF position. And the invention, in its preferred embodiment, is further enhanced by a latching means capable of holding the actuator in the OFF position until it is manipulated to release its hold.

The present invention is an improvement over applicant's related invention which is positionable to an OFF position that prevents product dispensation while allowing operation of the valve. Thus it is required to perform a secondary valving function, and that causes molds to produce the actuator to be complicated and costly. Conversely, molds for the present invention are no more complicated than conventional actuator molds because the present invention eliminates the need for the secondary function.

There remains, therefore, a requirement and therefore a need for a simplified actuator, for valve operation, that is child resistant. This need and requirement can best be fulfilled by the invention hereof.

SUMMARY OF THE INVENTION

The present invention discloses a child resistant valve actuator having a pushbutton type dispensing head and stop means which may be relatively positioned to prevent unintentional dispensation of fluid product.

It is an object of this invention to provide an improved child resistant actuator means having, a rotatably positionable dispensing head having at least one discharge orifice, and a stop means. The dispensing head and stop means being suitably adapted to facilitate incorporation with a substantially conventional aerosol valve (or pump means) for controlled dispensing of fluid from the interior of a product container to the exterior of the actuator means via the aerosol valve and discharge orifice.

Another object is to provide a stop means that cooperates with the dispensing head to govern operation of the valve.

Another object is to provide a dispensing head being rotatable relative to said stop means to at least one ON position whereat it may be depressed for operation of the valve, and at least one OFF position that prevents depression of the dispensing head and thereby prevents dispensing operation of the valve.

Still another object is to provide a dispensing head having an attached pawl being reciprocatively biased to retainingly engage the stop means and thereby impede rotation of the dispensing head relative to the stop means when the dispensing head is in said OFF position, and the pawl being depressibly disengagable to allow rotation of said dispensing head, with respect to the stop means, to said ON position.

Other objects, advantages and novel features of the invention will be apparent as it is better understood from the following description which, taken in connection with the accompanying drawings, disclose the preferred embodiment thereof.

DETAILED DESCRIPTION

Figure 1:
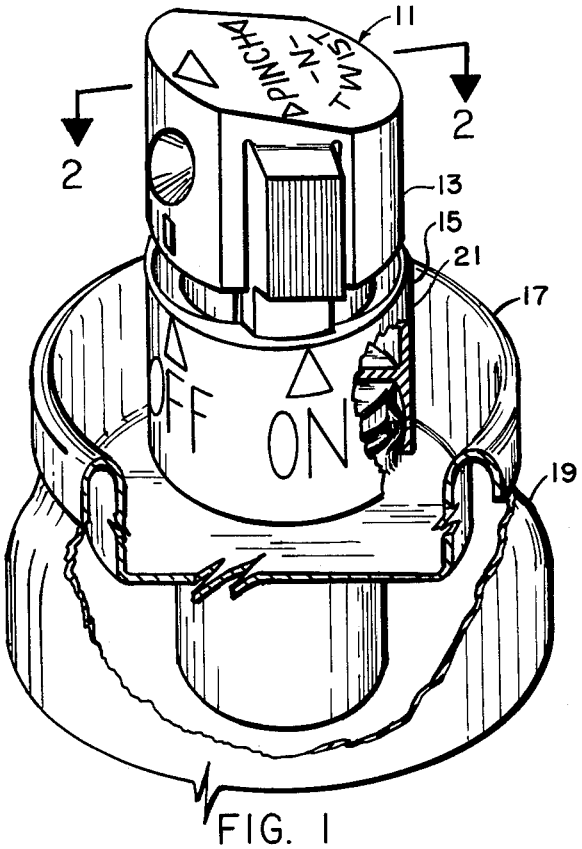
FIG. 1 is an isometric view of the actuator according to the invention, shown in an OFF position and mounted on a valved container with which the actuator may be utilized.

In the preferred embodiment, relating to a child resistant actuator means for governing operation of a normally closed (OFF) valve means mounted on a container of fluid product, there is shown in FIG. 1 a latching actuator means having a rotatably positional and reciprocatively depressible dispensing head 13, commonly termed pushbutton or nozzle, and a stop means 15 accordingly described in relation to an aerosol type dispenser having a substantially conventional dispensing valve 17 disposed on product container 19 for expulsion of fluid. As will be seen, however, the invention is not limited to aerosol type dispensers, it is likewise readily available for pump type dispensers. In such case dispensing head 13 and stop means 15 will be axially mounted on the pump device in a manner so as to achieve the same purpose as described in reference to aerosol type dispensers as hereinafter described.

Said dispensing head and stop means are cooperatively mounted on valve 17 and thereat said dispensing head is selectively positional relative to said stop means to an ON position that facilitates opening of said valve from an OFF position that prevents opening of said valve, and vice-versa. The stop means is generally considered to be stationary and the dispensing head is reciprocatively depressible, and rotatable relative thereto. However, the mounting of the stop means, in cooperation with said valve, effects a slip clutch that provides a limited resistance to rotation of the stop means, and thereby protects the actuator from damage by being rotatable with said dispensing head.

At this point it should be understood that dispensing head 13 is basically a conventional pushbutton type valve actuator that is modified to include latch means and stop means features that will be described hereinafter. Also, valve 17 may be a completely conventional valve. Therefore, for the sake of brevity and understanding, the conventional aspects of the actuator and valve will not be discussed in any more detail than necessary for understanding of the invention.

Stop means 15 has an upstanding cylindrical wall 21 which may have ON, OFF or other suitable indicia and upwardly pointing arrows associated therewith imprinted in appropriate locations on the exterior surface thereof. And, dispensing head 13 may have a position indicating line that corresponds to said indicia to aid a user in selecting the desired positioning of the dispensing head.

Figure 2:
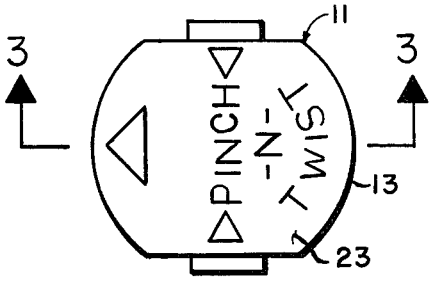
FIG. 2 is a top plan view of the actuator, taken in the direction of line 2—2 of FIG. 1.

And as seen in FIG. 2 the dispensing head has an upper wall 23 which may have an arrow applied thereto, indicating fluid discharge direction, together with arrows and imprinted operation indicia, such as PINCH-N-TWIST.

The dispensing head and stop means are preferably molded plastic parts having a substantially circular shape as viewed from the top, and fairly good spring characteristics. But, they may be made from any suitable material.

Figure 3:
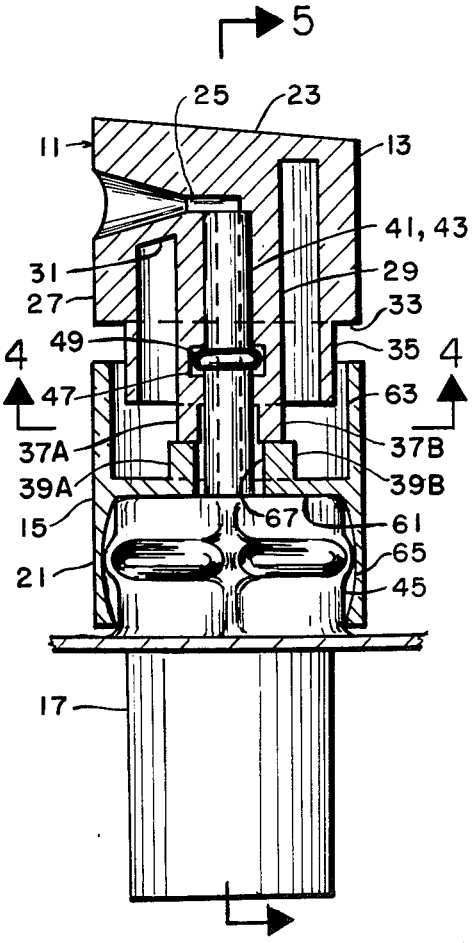
FIG. 3 is a longitudinal cross sectional view, of the actuator mounted on a valve means, taken in the direction of line 3—3 of FIG. 2.

Dispensing head 13, as shown in FIG. 3, has a discharge port 25 that is in flow through communication with valve 17. And depending from upper wall 23 is a substantially circular outer wall 27 and a hollow inner cyclindrical sleeve 29 having a common axis, and each has an open lower end. Port 25 extends into the hollow of said sleeve and is surrounded by a conical shape wall 31 extending between wall 27 and sleeve 29.

In addition, wall 27 is abruptly stepped inwardly providing a substantially circular shoulder 33 and a cylindrical extending wall 35 that protrudes a short distance into stop means 15 when said dispensing head is in its upper most mounted position. And depending from the lower end of sleeve 29 are two, diametrically situated, like abutments 37A and 37B that extend downwardly. Said abutments are radially located to be in a line parallel to the axis of port 25, and they are adapted to abut corresponding stops 39A and 39B provided in said stop means, which will be described later.

The hollow, designated 41, of sleeve 29 corresponds with the outer diameter of a depressible valve stem 43 that projects upwardly from a crimped valve unification cup 45 centrally located at the top of said valve and extends into hollow 41. Abutments 37A and 37B are spaced apart sufficiently to provide space for said stem therebetween. There is also formed in hollow 41 an annular groove 47 that cooperates with an annular bead 49, that encircles stem 43, to provide a means for keeping said dispensing head and said valve held together.

Figure 4:
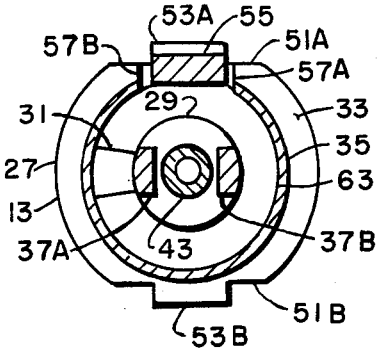
FIG. 4 is a cross sectional view taken along a horizontal plane in the direction of line 4—4 of FIG. 3, the stop means being omitted for clarity.
Figure 5:
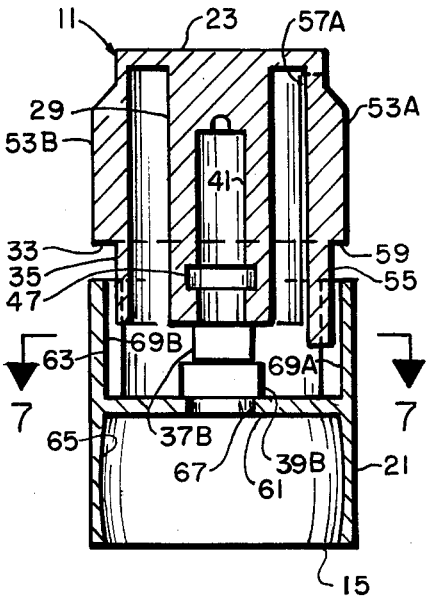
FIG. 5 is a longitudinal cross sectional view, taken along line 5—5 of FIG. 3, to best illustrate latching features of the actuator, the valve means is omitted for clarity.

Along opposite exterior surfaces of wall 27, as best seen in FIG. 4, are flattened sides 51A and 51B, each having an outwardly projecting pad 53A and 53B, located perpendicular to the axis of said port. Along opposite sides of pad 53A there are two slits (one on each side) 57A and 57B which extend upwardly from the lower end of wall 35 and terminate a slight distance beneath upper wall 23. Depending from, and projecting downwardly beneath pad 53A, as seen in FIG. 5, is a latch means or pawl 55 that extends past the lower end of wall 35 but not past the lower end of said abutments. Pawl 55 is stepped inwardly from the outermost surface of pad 53A, at designation 59, a distance that is sufficient for extention of the pawl into said stop means and latching engagement therein.

Figure 6:
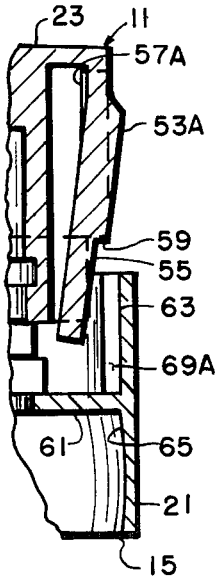
FIG. 6 is a partial view similar to FIG. 5 illustrating disengagement of the latching feature.

Said slits, in conjunction with the spring characteristic of the dispensing head material, enable reciprocative movement of pawl 55 in an inwardly direction, as seen in FIG. 6, for engagement or disengagement from either of two catch means 69A or 69B described below. Said pads are suitably shaped to provide readily identifiable locations for a user to grip the dispensing head, between a thumb and forefinger, for rotational positioning and at the same time pinch the dispensing head sides depressing pawl 55 thereby disengaging said pawl from said catch means.

Referring again to FIG. 3, said stop means is internally divided, by partition 61, into upper and lower portions designated 63 and 65 respectively. Centrally located in partition 61 is a clearance hole 67 that accommodates free longitudinal movement of stem 43 therein. Within said lower portion the wall surface is circular having a concaved cross sectional shape adapted to provide a snap on, snug, encircling engagement with valve cup 45 so as to effect a torsional slip clutch function therewith to limit the force that can be applied at said latch means.

It should be obvious from the foregoing that the valve counterpart, pump means (not shown) and hereintofore referred to as the pump device, is conventionally provided with a pump unification means that is analogous with the valve unification cap. Typically, the pump unification means is a raised protruberance provided in the container closure portion of the pump means. Like the valve unification cup, holds the individual components of the pump means together as a unit.

Figure 7:
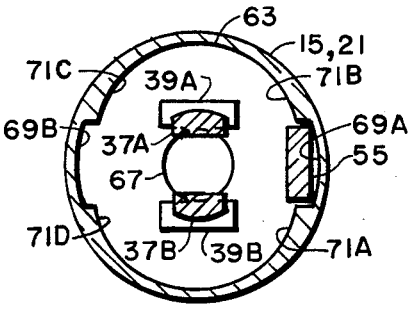
FIG. 7 is a cross sectional view taken along a horizontal plane in the direction of line 7—7 of FIG. 5 to further depict the latching feature engagement.

Now in viewing FIG. 7 and referring to FIG. 5, in upper portion 63 of said stop means there is a first catch means 69A and an identical catch means 69B diametrically located and recessed into the inside surface of wall 21. Each catch means is in the form of a vertical channel that extends the full height of said upper portion. The width of said channels corresponds to the width of said pawl so as to facilitate said latching engagement.

Within said upper portion, the walls are inwardly curved at designations 71A, 71D, and 71B, 71C providing gradual wall thickness increases that are at maximum at locations coinciding with sides of channels 69A and 69B respectively. Surface curvatures designated 71A and 71D blend together forming a single constant radius having an origin point located on a horizontal center line between said grooves. Curvatures designated 71B and 71C blend together in the same manner.

The curvatures serve as cams for pawl 55 to bear against, so that said pawl will move inwardly for engagement with a catch means as the dispensing head is rotated from said ON to said OFF position. The curvatures facilitate automatic latching whenever the dispensing head is rotated to said OFF position.

Also, within the upper portion of said stop means, there are two like stops 39A and 39B which are disposed on and rise upwardly from partition 61, on opposite sides of hole 67. Said stops are located, on a center line that runs perpendicular to said catch means, so as to be beneath abutments 37A and 37B, respectively, when said dispensing head is in said OFF position. The stops are sized to correspond to said abutments to facilitate operation of said dispensing head for said ON, OFF functions. Said stops and abutments may be of any suitable configuration.

FIG. 3, FIG. 5, and FIG. 7 illustrate the child resistant aspect of said actuator, whereas, the dispensing head is in said OFF position and thereat the relationship of abutments 37A and 37B with respect to stops 39A and 39B (37A and 39A are not shown in FIG. 5) prevents depression of said dispensing head and thereby prevents opening of said valve. And as previously described, the latching means prevents rotation of said dispensing head to an alternative position except when pad 53A is inwardly depressed to release the latch and catch engagement. Should the dispensing head be rotated while the latch means is engaged with a catch means, the stop means will simply rotate with the dispensing head without changing the positional relationship thereof.

Figure 8:
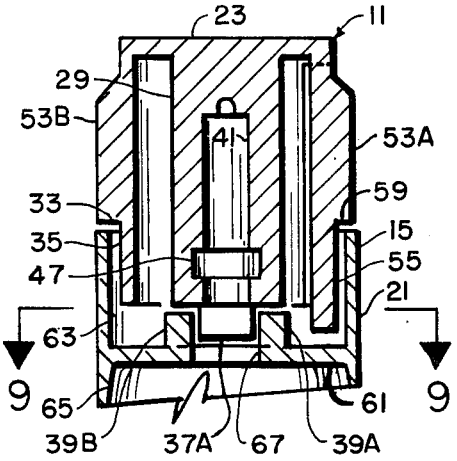
FIG. 8 is a cross sectional view, similar to FIG. 5, illustrating a functional relationship of the dispensing head and stop means.
Figure 9:
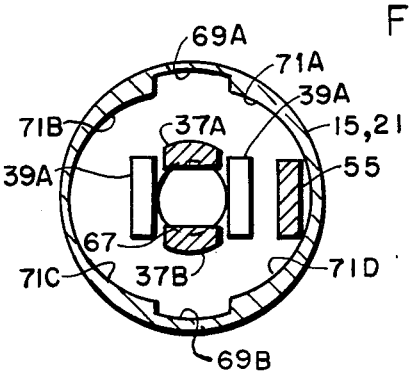
FIG. 9 is a cross sectional view taken along a horizontal plane in the direction of line 9—9 of FIG. 8 to further depict a functional relationship of the dispensing head and stop means.

FIG. 8 and FIG. 9 illustrate the dispensing head in said ON position (rotated 90° from the OFF position). In said 0N position said abutments are situated to freely pass between said stops facilitating depression of said dispensing head into the upper portion of said stop means for operation of said valve (not shown) to an open, dispensing position. The depressed position of said dispensing head is shown in FIG. 8. And FIG. 9 also shows the relationship of said latch means 55 with respect to catch means 69A and 69B when the dispensing head is in said ON position.

It should be understood that since two catch means are provided, four alternative rotational positions of the dispensing head are established. There are two OFF positions 180° apart and two ON positions 180° apart and perpendicular to said OFF positions. The purpose of four positions is to accommodate ease of operation by requiring only 90° rotation in either direction to change from one position to the other.

It is thought that the invention and its advantages will be understood from the foregoing description and it will be apparent that various changes may be made in form, construction and arrangement of parts without departing from the spirit and scope of the invention or sacrificing all of its material advantages, the form hereinbefore described being merely the preferred embodiment thereof.

Having described my invention, reference should now be had to the following claims.

I claim:

1. A child resistant actuator, having a discharge port, for mounting on and dispensing operation of a normally closed valve having a depressible stem that projects upwardly from a centrally located valve unification cup disposed on the product container of an aerosol dispenser, the actuator comprising:

a stop means having an upstanding cylindrical wall mounted by snap on encircling engagement with the valve cup, said cylindrical wall and valve cup engagement having limited resistance to rotation, the stop means also including a pair of stops diametrically spaced within said cylindrical wall;

a dispensing head, having an outer wall, adapted for mounting on and depressing said valve to a valve open position, and having a hollow inner sleeve into which the valve stem extends, and thereon said dispensing head being rotatable relative to said stop means from an ON position of the valve and vice-versa;

said sleeve having a lower end and diametrically spaced and depending therefrom a pair of abutments that correspond with and abut said stops in said OFF position; the stops when beneath the abutments preventing valve opening operation of the dispensing head, and in said ON position the abutments being situated to freely pass between the stops to facilitate valve opening operation of the dispensing head;

said actuator also including a latching means having at least one latch member and at least one catch member being in latching engagement in said OFF position, whereby, said engagement prevents said dispensing head from being turned to said ON position;

said dispensing head outer wall having diametrically opposite side portions that accommodate grasping in a pinching manner and turning manipulation of the dispensing head, at least one of said side portions and member of said latching means being cooperative and moveably responsive to said grasping for release of said latching engagement to facilitate turning of said dispensing head from said OFF position to said ON position.

2. In the invention of claim 1, the engagement of said stop means with said valve cup providing a slip clutch having resistance to rotation, but, allowing rotation of the stop means with the dispensing head whenever the latching means members are in latching engagement.

3. In the invention of claim 1, the cylindrical wall of said stop means having an inside surface and recessed therein at least one vertical channel that defines the catch member of said latching means.

4. In the invention of claim 3, said cylindrical wall having on the inside surface thereof blending curvatures that increase the wall thickness at locations coinciding with sides of said channel and serve as cams that facilitate automatic latching engagement of said latch member with said catch member whenever the dispensing head is rotated to said OFF position.

5. In the invention of claim 1, said side portions of the dispensing head each having an outwardly projecting pad, and said latch member being a pawl depending from and projecting downwardly beneath one of said side portions and therewith being inwardly moveable and reciprocatively biased to facilitate said latching engagement and disengagement.

6. A child resistant pump actuator, having a discharge port, for mounting on and reciprocative dispensing operation of a normally closed pump means having a depressible stem that projects upwardly from a pump unification means disposed on the product container of a fluid product dispenser, the actuator comprising:

a stop means having an upstanding cylindrical wall mounted by snap on engagement with the pump unification means said cylindrical wall and pump unification means, engagement having limited resistance to rotation, the stop means also including a pair of stops diametrically spaced within said cylindrical wall;

a dispensing head, having an outer wall and adapted for mounting on and depressing said pump stem to a pump open position said dispensing head having a hollow inner sleeve into which the pump stem extends, and thereon said dispensing head being rotatable relative to said stop means from an ON position that facilitates depression of the dispensing head for dispensing operation of the pump means to an OFF position that prevents depression of the dispensing head for dispensing operation of the pump means and vice-versa;

said sleeve having a lower end and diametrically spaced and depending therefrom a pair of abutments that correspond with and abut said stops in said OFF position; the stops when beneath the abutments preventing a dispensing operation of the pump means, and in said ON position the abutments being situated to freely pass between the stops to facilitate dispensing operation of the pump means;

said actuator also including a latching means having at least one latch member and at least one catch member being in latching engagement in said OFF position, whereby, said engagement prevents said dispensing head from being turned to said ON position;

said dispensing head outer wall having diametrically opposite side portions that accommodate grasping in a pinching manner and turning manipulation of the dispensing head, at least one of said side portions and member of said latching means being cooperative and moveably responsive to said grasping for release of said latching engagement to facilitate turning of said dispensing head from said OFF position to said ON position.

7. In the invention of claim 6, the engagement of said stop means with said pump unification means providing a slip clutch having resistance to rotation, but, allowing rotation of the stop means with the dispensing head whenever the latching means members are in latching engagement.

8. In the invention of claim 6, the cylindrical wall of said stop means having an inside surface and recessed therein at least one vertical channel that defines the catch member of said latching means.

9. In the invention of claim 8, said cylindrical wall having on the inside surface thereof blending curvatures that increase the wall thickness at locations coinciding with sides of said channel and serve as cams that facilitate automatic latching engagement of said latch member with said catch member whenever the dispensing head is rotated to said OFF position.

10. In the invention of claim 6, said side portions of the dispensing head each having an outwardly projecting pad, and said latch member being a pawl depending from and projecting downwardly beneath one of said side portions and therewith being inwardly moveable and reciprocatively biased to facilitate said latching engagement and disengagement.

* * * * *